US005415309A

United States Patent [19]

Wang

[11] Patent Number: 5,415,309

[45] Date of Patent: May 16, 1995

[54] AIRTIGHT MULTIPLE FOOD CONTAINERS

[76] Inventor: Paul S. Wang, 22428 Steeplechase La., Diamond Bar, Calif. 91765

[21] Appl. No.: 287,811

[22] Filed: Aug. 9, 1994

[51] Int. Cl.[6] ..... B65D 65/00

[52] U.S. Cl. ..... 220/4.27; 220/212; 220/735

[58] Field of Search ..... 220/4.27, 212, 521, 220/735; 206/507, 509, 511; 215/DIG. 5

[56] References Cited

U.S. PATENT DOCUMENTS

| | | | |
|---|---|---|---|
| 854,745 | 5/1907 | King | 30/150 |
| 1,452,337 | 4/1923 | Brecel | 30/147 X |
| 2,326,414 | 8/1943 | Thompson | 220/4.27 |
| 3,369,691 | 2/1968 | Wei | 220/4.27 |
| 3,624,787 | 11/1971 | Newman | 220/212 |
| 3,679,093 | 7/1972 | Chang | 220/735 X |
| 4,036,392 | 7/1977 | Martin | 220/521 |
| 4,036,398 | 7/1977 | Hoogvelt et al. | 220/735 X |
| 4,474,303 | 10/1984 | Maccise | 220/4.27 |
| 5,197,623 | 3/1993 | Wang | 220/212 |
| 5,261,560 | 11/1993 | Wang | 220/212 X |
| 5,339,975 | 8/1994 | Stoner | 220/4.27 |

*Primary Examiner*—Steven M. Pollard

[57] ABSTRACT

Multiple containers are provided for carrying the same or different types of food independently of one another, and which may be securely locked to one another in a compact stack for ease of carrying. The upper container is provided with a channel for receiving a utensil receptacle in a snap-fit relationship, and a utensil in the form, for example, of a plastic spoon-shaped fork is pivotally mounted to the receptacle to be turned to extend along the underside of the receptacle when the receptacle is mounted in place on the cover of the upper container, and which may be turned to extend out of the end of the receptacle when the utensil is to be used.

3 Claims, 3 Drawing Sheets

FIG. 4
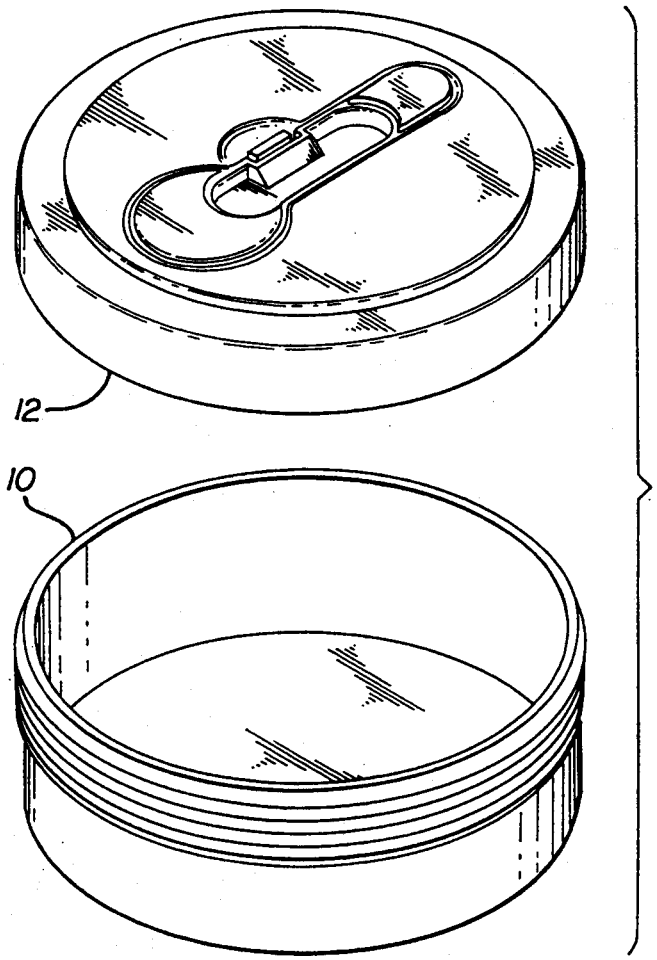
FIG. 5
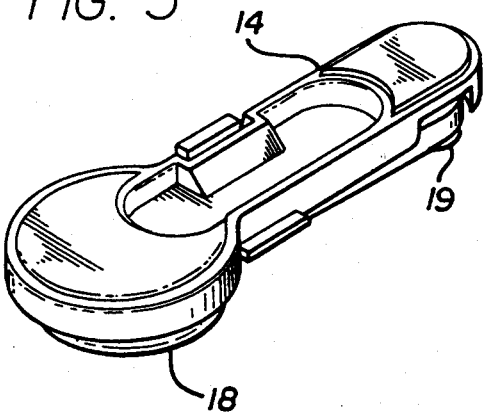
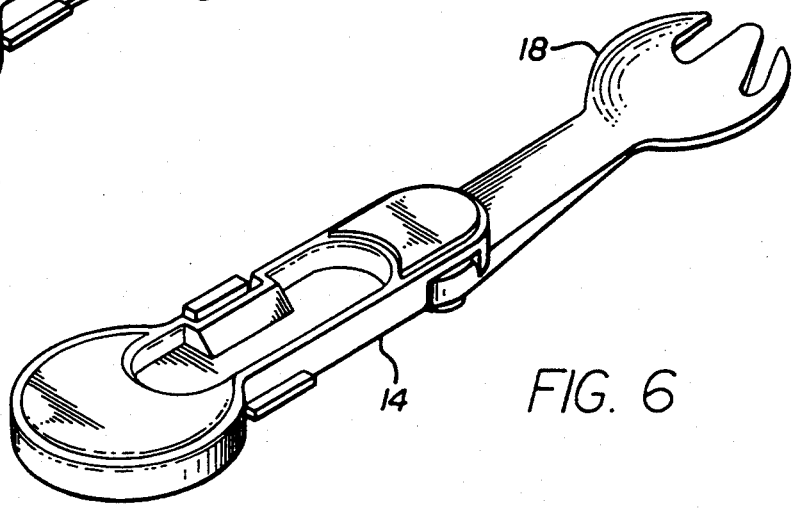
FIG. 6

AIRTIGHT MULTIPLE FOOD CONTAINERS

BACKGROUND OF THE INVENTION

Multiple airtight containers are provided for carrying different types of food, and which may be securely locked to one another as a compact stack for ease of carrying. The cover of the upper container is provided with a channel for storing a utensil receptacle in a snap-fit relationship. The utensil receptacle contains, for example, a plastic spoon-shaped fork which is pivotally mounted to the receptacle, and which may be turned out of the receptacle for use after the receptacle has been removed from the cover of the upper container. The containers are particularly useful for carrying snacks or lunches for children at school or on picnics.

The containers of the invention are preferably formed of a plastic material, and each is equipped with a cover threaded to the open top of the body portion of the corresponding container. The cover is also preferably formed of a plastic material. The containers are similar in construction to the container described in U.S. Pat. No. 5,197,623 which issued Mar. 30, 1993 to Paul S. Wang, the present inventor.

The bottom of the upper container includes a plurality of coaxial arcuate locking flanges which are located in angularly-spaced relationship with one another, and which are shaped to lock with a corresponding plurality of locking flanges formed in an angularly-spaced relationship on the top of the cover of the lower container. This permits the upper container to be placed over the lower container and then turned to a locking position with respect to the lower container. The bottom of the lower container may include similar arcuate flanges to permit it to be locked with like containers to form a locked multiple container stack.

BRIEF DESCRIPTION OF THE DRAWINGS

FIG. 4 is a view of the container of FIG. 1 with the cover removed from the jar;

FIG. 5 is a perspective view of the utensil receptacle which is supported on the top of the cover;

FIG. 6 is a perspective view of the receptacle showing the utensil turned to protrude through the end of the receptacle in position to be used, with the receptacle serving as a handle for the utensil;

DETAILED DESCRIPTION OF THE ILLUSTRATED EMBODIMENT

The upper container is designated 10 in FIGS. 1–4, and it has a cover 12 screwed to its open top, as best shown in FIG. 4. The container 10 and cover 12 are preferably formed of plastic material.

Figure 7:
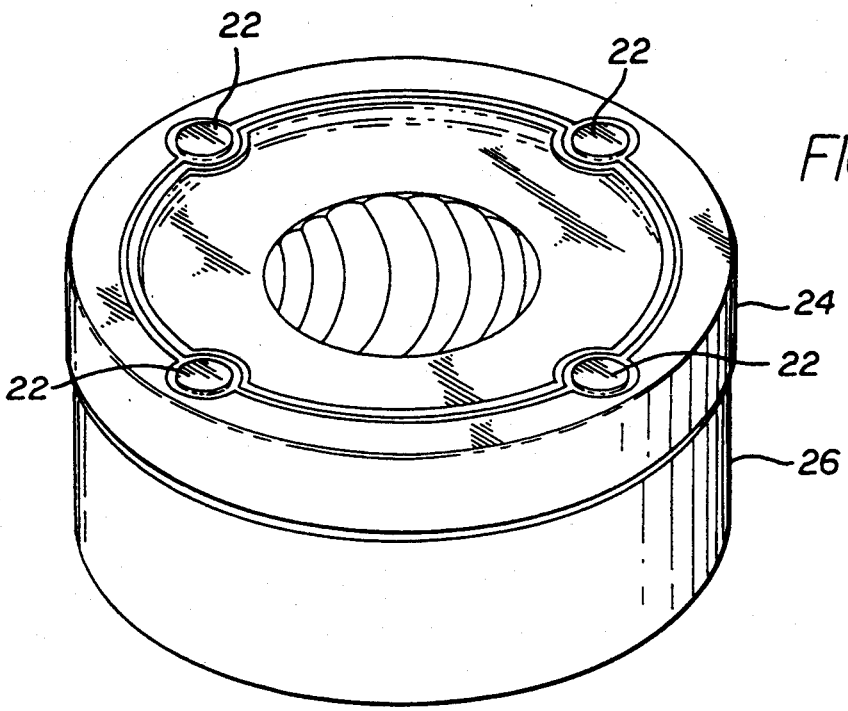
FIG. 7 is a side perspective view of a container forming the lower container in the multiple container stack of the present invention.

A similar lower container is designated 26 in FIG. 7, and it has a cover 24 which, as was the case with the upper container, is screwed to the open top of the lower container. The lower container likewise is preferably formed of plastic material, as is its cover 24. The lower container may contain the same food as the upper container or, if so desired, different food may be stored in the lower container independently of the food contained in the upper container.

Figure 1:
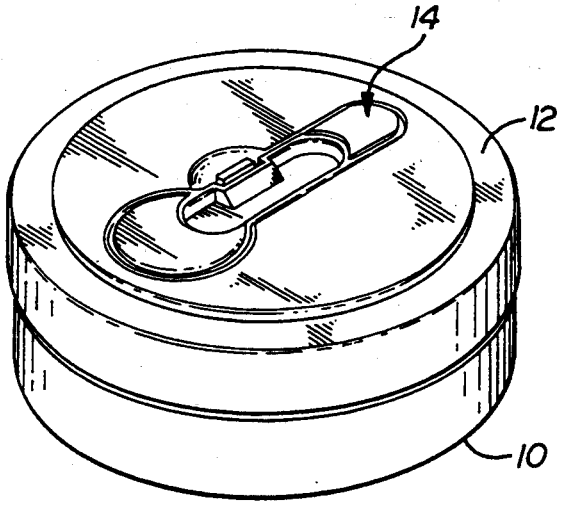
FIG. 1 is a side perspective view of a container constructed to serve as the upper container in the multiple container stack of the present invention and having a cover threaded to the open top of the container, and with a utensil receptacle snapped into place in a channel in the cover.
Figure 2:
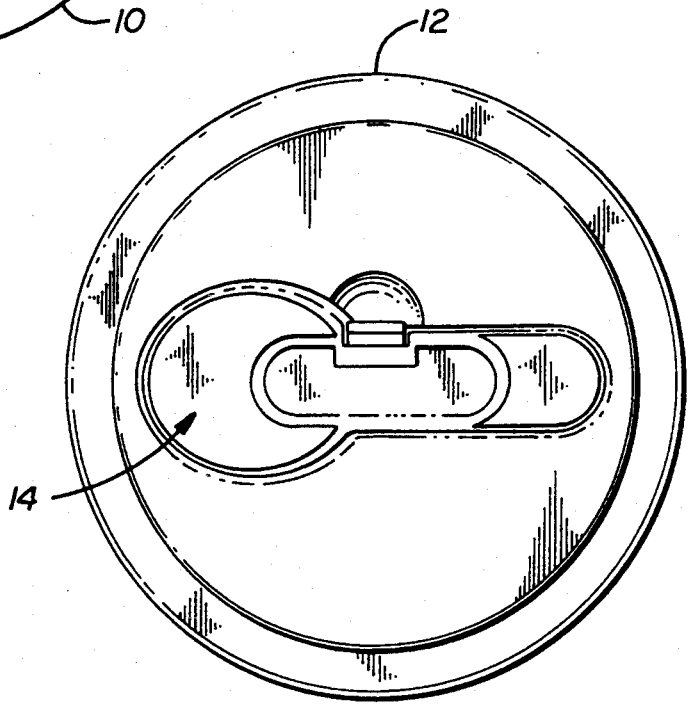
FIG. 2 is a top plan view of the container of FIG. 1.

An elongated receptacle 14 is carried in an elongated channel formed on the top of the cover 12 of the upper container, and the receptacle is snapped into a snap-fit relationship with the channel, as shown in FIGS. 1 and 2. An appropriate utensil, such as a spoon-shaped plastic fork 18 is pivotally mounted to the underside of receptacle 14 by a pivot pin 19, as shown in FIG. 5. The utensil 18, as shown in FIG. 5, may be folded under the receptacle 14 so that the receptacle may be snapped in place on cover 12. When the utensil is to be used, the receptacle 14 is removed from the cover and the utensil 18 is turned to protrude through the end of the receptacle, as shown in FIG. 6. The receptacle may then be used as a handle for the utensil 18.

Figure 3:
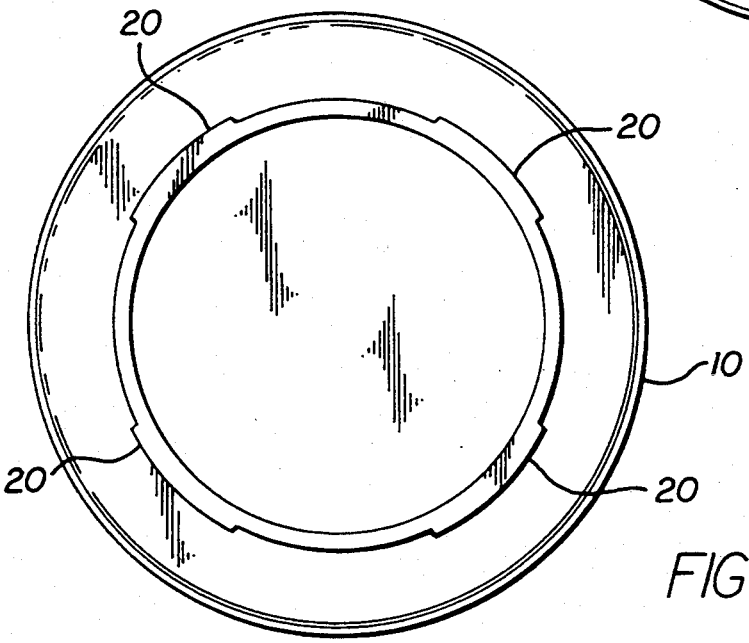
FIG. 3 is a bottom view of the container of FIG. 1.

The bottom of the upper container 10, as shown in FIG. 3, has four arcuate locking flanges 20 positioned concentrically with respect to the center of the bottom in spaced angular relationship. These flanges are positioned to lock with corresponding locking members 22 formed on the top of the cover 24 of lower receptacle 26, when the upper receptacle is placed on top of the lower receptacle and then turned to a locking position. In other respects the lower container 26 is the same as the upper container 10.

Figure 8:
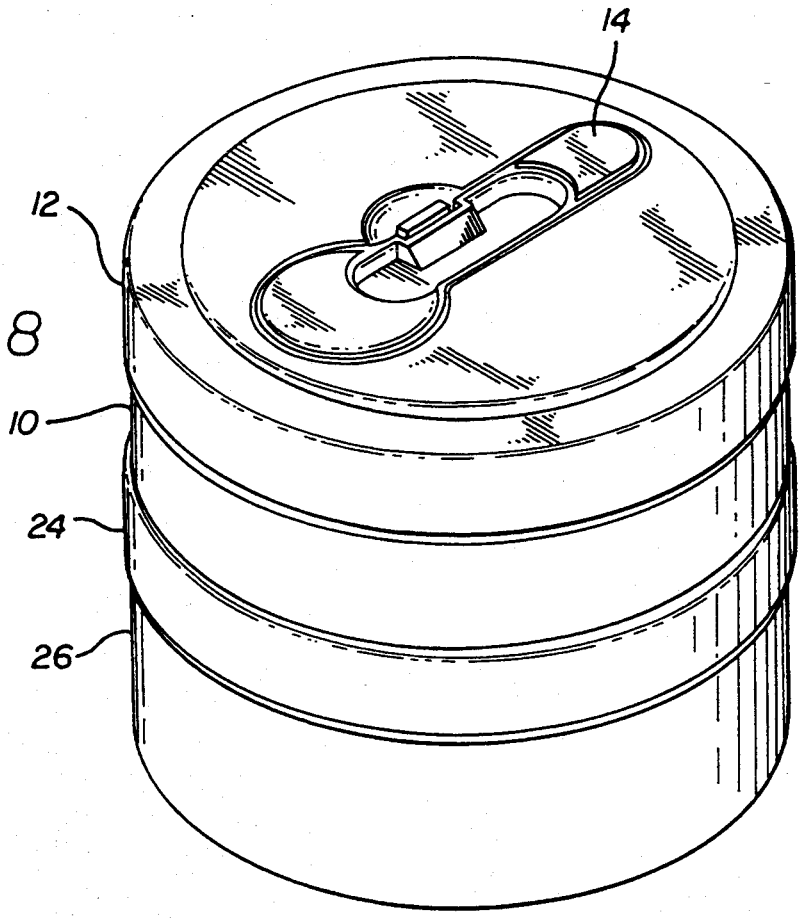
FIG. 8 is a view of the upper container of FIG. 1 stacked and locked in position over the lower container of FIG. 7.

The construction described above permits containers 10 and 26 to be filled with the same or different types of food, and then to be stacked in a securely locked stack, as shown in FIG. 8, so that the containers may be easily carried. Each container may then be used independently of the other insofar as the removal of its contents is concerned.

In use, the containers 10 and 26 are removed from the stack of FIG. 8 by turning one relative to the other. The covers 12 and 24 are then removed and the separate containers are filled with selected food. The covers are then screwed back in place on the respective containers. Then the upper container is placed on top of the lower container and turned to a locked position to form the stack of FIG. 8.

As stated above, similar arcuate flanges may be formed on the bottom of the lower container 26 to permit it to be stacked and locked with additional containers if so desired.

It will be appreciated that while a particular embodiment of the invention has been shown and described, modifications may be made. It is intended in the following claims to cover all such modifications which fall within the true spirit and scope of the invention.

I claim:

1. A container assembly including at least two containers constructed to be stacked on top of one another as an upper container and a lower container, each of said containers having a closed bottom and an open top, each of said containers having a cover removably attached to said open top; the bottom of said upper container and the cover of said lower container having locking members formed thereon which may be locked with one another when the upper container is placed on top of the lower container to form a rigid stack, and in which said locking members on the bottom of said upper container are in the form of arcuate flanges concentric with respect to the center of said bottom of said upper container and angularly spaced from one another, and the locking members formed on the cover of said lower container define slots for receiving said arcuate flanges when said upper container is placed on said lower container and turned to a locked position, the cover of said upper container having a channel formed in its upper surface, a utensil receptacle removably received in said channel in a snap-fit relationship, and at least one utensil pivotally mounted to the underside of said receptacle to be angularly movable between a first position in which it extends inwardly along the underside of said receptacle and a second position in which it protrudes beyond the end of said receptacle, so that said receptacle may function as a handle for said utensil when said utensil is in said second position.

2. The container assembly defined in claim 1 in which the bottom of the lower container also has locking members formed thereon in the form of arcuate flanges concentric with respect to the center of said bottom of said lower container and angularly spaced from one another to permit additional containers to be locked in place and included in said rigid stack.

3. The container assembly defined in claim 1 in which the utensil is in the form of a spoon-shaped fork.

* * * * *